US005295278A

United States Patent [19]

Condon et al.

[11] Patent Number: 5,295,278

[45] Date of Patent: Mar. 22, 1994

[54] ADJUSTABLE TUBE AND FITTING CLEANING BRUSH

[75] Inventors: Duane R. Condon, Ramona; Larry D. Brown, San Diego, both of Calif.

[73] Assignee: Securus, Inc., San Marcos, Calif.

[21] Appl. No.: 26,435

[22] Filed: Mar. 4, 1993

[51] Int. Cl.[5] ..... B08B 9/02

[52] U.S. Cl. ..... 15/104.04; 15/104.05; 15/106; 15/114; 15/118; 15/160; 15/176.6; 15/244.1; 51/181 NT; 51/393

[58] Field of Search ..... 51/181 NT, 205 WG, 392, 51/393; 15/104.03, 104.04, 104.05, 106, 114, 118, 160, 164, 167.2, 176.1, 176.6, 214, 220.3, 244.1

[56] References Cited

U.S. PATENT DOCUMENTS

| | | | |
|---|---|---|---|
| 57,149 | 8/1866 | Johnson . | |
| 348,508 | 8/1886 | Barber | 15/106 |
| 675,612 | 6/1901 | Van Horn et al. . | |
| 705,534 | 7/1902 | Klauberg . | |
| 1,118,838 | 11/1914 | Beeks . | |
| 1,270,137 | 6/1918 | Forde . | |
| 1,546,322 | 7/1925 | Solary | 15/104.5 |
| 1,766,870 | 11/1928 | Becker . | |
| 1,905,399 | 4/1933 | Wagner | 15/160 |
| 1,921,002 | 8/1933 | Ozabal . | |
| 2,003,629 | 6/1935 | Coffey . | |
| 2,196,942 | 4/1940 | Roberts . | |
| 2,242,134 | 5/1941 | Lynn . | |
| 2,405,680 | 8/1946 | Williams . | |
| 2,551,875 | 11/1948 | Cotton . | |
| 2,683,274 | 7/1954 | Kappes . | |
| 2,850,754 | 9/1958 | Davis | 15/104.04 X |
| 2,922,218 | 1/1960 | Lewis . | |
| 3,413,673 | 12/1968 | Gewirz . | |
| 3,486,183 | 6/1967 | Caprioli . | |
| 3,545,081 | 12/1970 | Butler | 15/104.03 X |
| 3,621,505 | 11/1971 | Vocker et al. . | |
| 3,745,622 | 7/1973 | DeAmicis . | |
| 4,038,715 | 8/1977 | Litt . | |
| 4,121,486 | 10/1978 | Frank . | |
| 4,133,069 | 1/1979 | Sunshine . | |
| 4,133,070 | 1/1979 | Litt | 51/392 X |
| 4,301,567 | 11/1981 | Tucker . | |
| 4,375,115 | 3/1983 | Zimmerman . | |
| 4,899,409 | 2/1990 | Cox, Jr. . | |
| 5,119,602 | 6/1992 | Shemesh . | |
| 5,146,717 | 9/1992 | Shemesh et al. . | |
| 5,168,660 | 12/1992 | Smith | 51/181 NT |

OTHER PUBLICATIONS

The Mill-Rose Company brochure, "Expanded Line of P/H/C Products" Sep. 1990.

The Mill-Rose Company brochure, "Introducing Better Products to the Trade Since 1915", date unknown.

Schaefer Brush Manufacturing Co. Catalog, p. 1, date unknown.

*Primary Examiner*—Harvey C. Hornsby
*Assistant Examiner*—Charles Cooley
*Attorney, Agent, or Firm*—Knobbe, Martens, Olson & Bear

[57] ABSTRACT

A cleaning tool for preparing the surfaces of pipes and fittings for soldering, welding or gluing comprises a base and a pair of opposing prongs. The tool further includes a distal set of replaceable brushes for cleaning the inner surfaces of pipes or fittings and a proximal set of replaceable abrasive pads for cleaning the outer surfaces of pipes and fittings. The tool is configured to accommodate pipes and fittings of a variety of diameters.

20 Claims, 4 Drawing Sheets

TRANSVERSE AXIS
LATERAL AXIS
LONGITUDINAL AXIS 2b
2b
R
θ
Γ

92a
98
99
95a
96
91a
93a
97
94a 110
96
112
99
92a
97
91a
3b
3b
100a
90
98
114
71a
10a
73a

ADJUSTABLE TUBE AND FITTING CLEANING BRUSH

BACKGROUND OF THE INVENTION

1. Field of the Invention

The present invention generally relates to cleaning tools, and more particularly, to cleaning tools for removing debris from interior and exterior surfaces of pipes and fittings of various diameters.

2. Description of the Related Art

Conventional preparation of pipes and fittings for soldering, welding or gluing, commonly involves removing or cleaning grease, metallic oxides (e.g., rust), dirt and/or like debris from the pipes and fittings to ensure that the solder or glue will adhere to the pipe surface or that the welded joint will not contain impurities. This task commonly requires the use of a variety of brushes and/or abrasive elements to scour the internal and external surfaces of the pipes and fittings. In addition, a number of different size cleaning tools are normally required to clean pipes and fittings of different diameters.

Most prior pipe cleaning devices can only clean either the inner or the outer surface of pipes. Typical examples include U.S. Pat. No. 2,551,875, which can only be used to clean the inner surface of pipes, and U.S. Pat. No. 3,621,505 to Vocker, et al., which can only be used to clean the outer surfaces of pipes.

Several prior pipe cleaning devices have been designed to clean both the internal and external surfaces of pipes. Examples of such devices are disclosed in U.S. Pat. No. 2,551,875 to Cotton and U.S. Pat. No. 2,922,218 to Lewis. These devices, however, suffer from several drawbacks.

Some of these prior cleaning devices only accommodate pipes and fittings of a particular diameter. For example, the tool disclosed in U.S. Pat. No. 2,922,218 to Lewis is designed to fit a particular size diameter of a pipe or fitting. The tool is thus dedicated to a particular size pipe.

Other prior cleaning tools, such as that disclosed in U.S. Pat. No. 2,551,895 to Cotton, are complicated, which increases manufacturing costs and decreases reliability. Moreover, these devices are rendered useless once the cleaning elements of the devices are worn.

SUMMARY OF THE INVENTION

In view of the foregoing drawbacks and shortcomings of prior cleaning tools, there exists a need for a cleaning tool to clean both the inner and outer surfaces of pipes or fittings of various diameters, which is simple in design and easy to use. There is also a need to provide replaceable cleaning elements to extend the life of the tool.

The present invention provides a simple cleaning tool for preparing plumbing components of varying diameters to be soldered, welded, glued or likewise interconnected. The cleaning tool comprises a flexible, generally U-shaped body, a pair of abrasive members and a pair of brushes. The U-shaped body has a pair of opposing prongs extending outwardly from a base. The tool is preferably configured to have variable deflection to accommodate pipes and fittings of various sizes.

The abrasive members are disposed on the opposing interior surfaces of the opposing prongs and are positioned distal of the base. As used herein, "distal" and "proximal" refer to the proximity of the base of the flexible body. The brushes are positioned generally opposite from each other, with the bristles of each brush extending away from a longitudinal axis of the tool. The brushes are desirably laterally offset from each other such that with the prongs urged together, the brushes are generally parallel to each other.

In a preferred embodiment, a first prong of the tool has an inner side and outer side. The prong comprises a proximal arm extending into a central hollow, which in turn extends into a brush. The central hollow defines a concave relief disposed on the inner side of the prong. The abrasive member fits within the concave relief and is advantageously removably secured to the prong. The brush, extending from the distal end of the central hollow, comprises a generally U-shaped channel and a plurality of bristles retained within the channel. These bristles extend outwardly from the outer side of the prong. The bristles are desirably removably attached within the channels. A second prong of the tool is substantially identical to the first prong and is oriented with the inner side of the second prong opposing the inner side of the first prong. Thus, the abrasive pad on the second prong directly opposes the abrasive pad on the first prong, and the brush of the second prong faces away from the brush on the first prong.

The base preferably has an arcuate shape and interconnects the first and second prongs such that a distance between the central hollows is greater than the diameter of the pipe or fitting to be cleaned.

BRIEF DESCRIPTION OF THE DRAWINGS

These and other features of the invention will now be described in detail with reference to the drawings of preferred embodiments which are intended to illustrate, and not to limit, the invention, and in which:

FIG. 3*a* is a partially exploded perspective view of a cleaning tool in accordance with another preferred embodiment of the present invention;

FIG. 3*b* is a cross-sectional view of an external brush taken along line 3*b*–3*b* of FIG. 3*a.

DETAILED DESCRIPTION OF PREFERRED EMBODIMENTS

Figure 1:
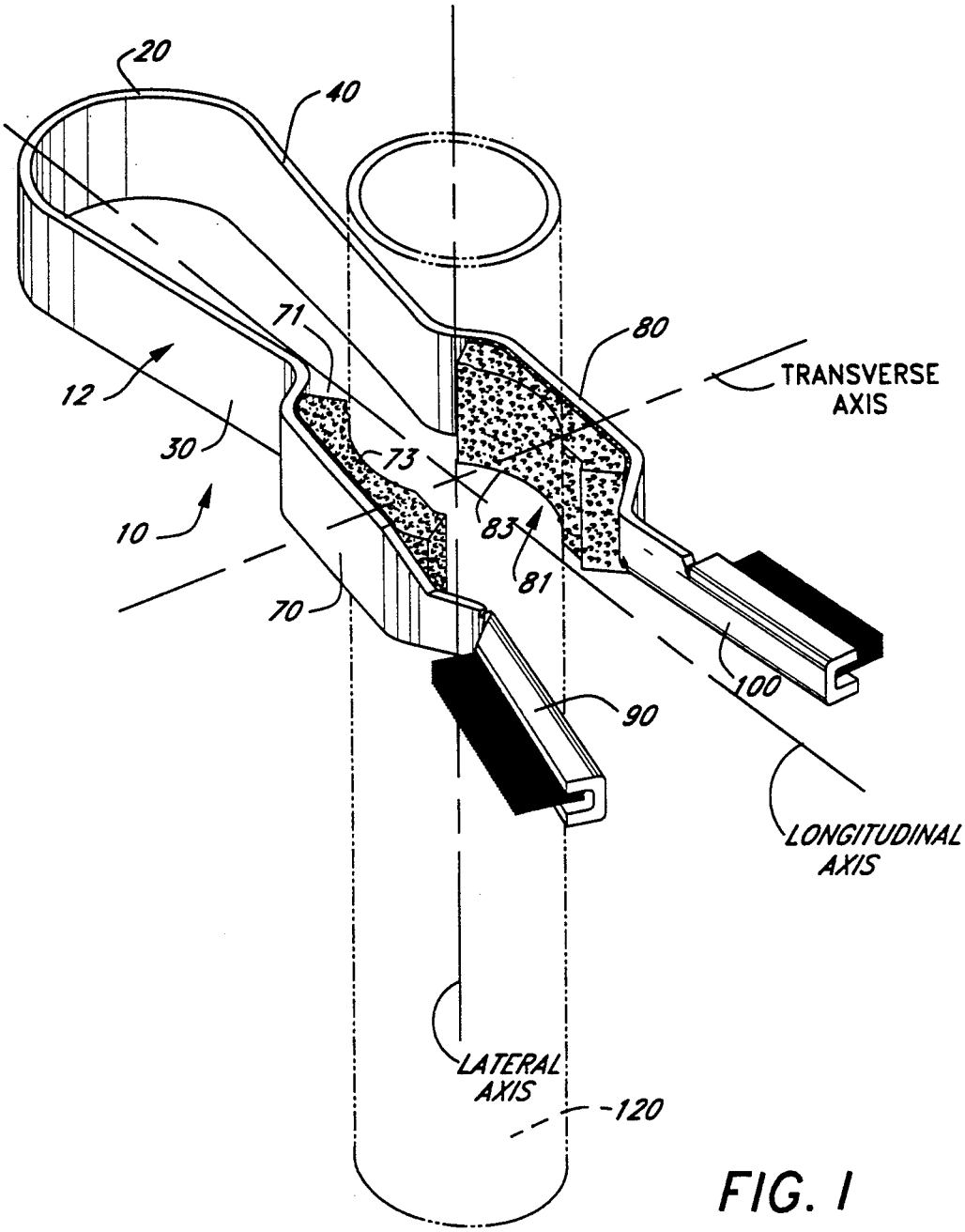
FIG. 1 is a perspective view of a cleaning tool in accordance with a preferred embodiment of the present invention being used to clean an outer surface of a pipe.

FIG. 1 illustrates a cleaning tool 10 in accordance with a preferred embodiment of the present invention, for cleaning the interior and exterior surfaces of pipes, fittings and like plumbing components. The cleaning tool 10 desirably has an ergonomic size to fit within a hand of a plumber and to be easily manipulated when used. The cleaning tool 10 is particularly suited for preparing pipes and fittings of various sizes for soldering, welding, gluing or like interconnection. It is contemplated, however, that those skilled in the art will realize that the cleaning tool 10 may be used to remove debris from other articles in different applications. For instance, the cleaning tool 10 may be used in connection with automotive assembly or repair, as well as with electrical wiring applications.

The tool 10 includes a flexible body 12 supporting a pair of exteriorly-oriented brushes 90, 100 on the distal end of the body 12 and a pair of interiorly oriented abrasive pads 73,83 located proximal of the brushes 90, 100. Again, as used herein, "proximal" and "distal" are used in reference to the proximity of a base 20 of the body 12. The exteriorly-oriented brushes 90, 100 are positioned generally for use in cleaning the interior surfaces of pipes or fittings, while the interiorly-oriented abrasive pads 73, 83 are positioned generally for use in cleaning the exterior surfaces of pipes or fittings.

The flexible body 12 is configured to accommodate a variety of pipe diameters. That is, the flexible body 12 preferably deflects from a first position, in which the largest diameter pipe with which the tool 10 is designed to be used is able to be inserted between the abrasive pads 73, 83, to a second position, in which the brushes 90, 100 are able to be inserted into the smallest diameter pipe with which the tool 10 is designed to be used. The tool 10 can thus be used on all pipe sizes that fall within the desired range of deflection. In an exemplary embodiment, the tool 10 is designed to be used with pipes sized between 0.5 inch and 0.1 inch in diameter. The flexible body 12 is therefore able from a first position, in which the abrasive pads are spaced apart by at least 1.25 inch, to a second position in which the combined height of the brush is equal to or less than 0.5 inch.

FIG. 1 illustrates a longitudinal axis, a transverse axis and a lateral axis in relation to the cleaning tool 10 to facilitate the following description. Additionally, as used herein, "the longitudinal direction" refers to a direction substantially parallel to the longitudinal axis. "The lateral direction" and "the transverse direction" are in reference to the lateral axis and transverse axis, respectively. The individual components of the cleaning tool 10 will now be described in detail.

The flexible body 12 illustrated in FIG. *2a* comprises a first prong 30 and a second prong 40 interconnected by the base 20. The tool 10 desirably is both mirrored and symmetrical about its longitudinal axis.

The base 20 advantageously has an arcuate shape which is preferably semicircular, defined by a radius R. The size and the shape of the base 20 are chosen so that a plumber can easily grasp and grip the cleaning tool 10 and that the spacing between the first and second prongs 30, 40 is greater than the outer diameter of the largest diameter pipe with which the tool is designed to be used. Thus, it is contemplated that the size and shape of the base 20 can readily be customized to suit specific design requirements. In an exemplary embodiment, the base is defined along a radius R of 0.7 inch. This radius R has been determined to provide a good fit of the base 20 with a standard-size adult male hand and to accommodate pipes having an outer diameter of 1.25 inches or smaller.

Each prong 30, 40 defines an inner side 32, 42 and an outer side 34, 44, respectively. The prongs 30, 40 have identical shapes, and are oriented with their inner sides 32, 42 opposing each other. It is therefore contemplated that the structure of the first and second prongs 30, 40 will be substantially identical, and a discussion herein of one will be understood as applying equally to both, unless specified to the contrary.

The first prong 30 comprises an arm 50 that extends from the base 20 and is inclined towards the longitudinal axis at an acute angle $\theta$. The angle $\theta$ is preferably selected to allow a thumb and a forefinger of the plumber to firmly grip the tool 10, and also to permit the prong 30 to be deflected through the desired range of deflection, as discussed above. In an exemplary embodiment, the angle $\theta$ is generally on the order of 10°.

The arm 50 of the prong 30 blends into a central hollow 70 which defines a concave relief 71 along the inner side 32 of the prong 30. The relief 71 is sized to receive at least a portion of the abrasive pad 73, as discussed below.

The central hollow 70 comprises a proximal transition member 74 that extends between a distal end of the arm 50 and a flat platform 75. The platform 75 has a length measured in the longitudinal direction sufficient to support the abrasive pad 73 and to provide an area large enough for a finger to contact. The longitudinal length of the platform 75 preferably is generally equal to about the outer diameter of the largest pipe with which the tool 10 is designed to be used. In an exemplary embodiment, the platform 75 has a longitudinal length equal to about 1.25 inches.

The platform 75 extends from the proximal transition member 74 to a distal transition member 76. As illustrated in FIG. *2d*, the distal transition member 76 tapers asymmetrically in width (measured in the lateral direction) with respect to the longitudinal axis to transition into the brush 90.

With reference to FIG. *2d*, the tool 10 may include notches 96 at the transition between the distal transition member 76 and the brush 90 to provide bend reliefs, as known in the art.

FIG. *2a* illustrates that the tool 10 additionally comprises a hook portion 72 of a hook and loop type fasteners, such as the type available commercially as VELCRO®, disposed along the inner side 32 of the central hollow 70 to attach the abrasive pad 73 to the central hollow 70. It is contemplated, however, that other types of fasteners, such as, for example, snaps, buttons, screws, or the like, can be used as well to affix the abrasive pad 73 to the central hollow 70. The abrasive pad 73 alternatively may be permanently attached to the central hollow 70 by an adhesive or like fastener.

Figure 4:
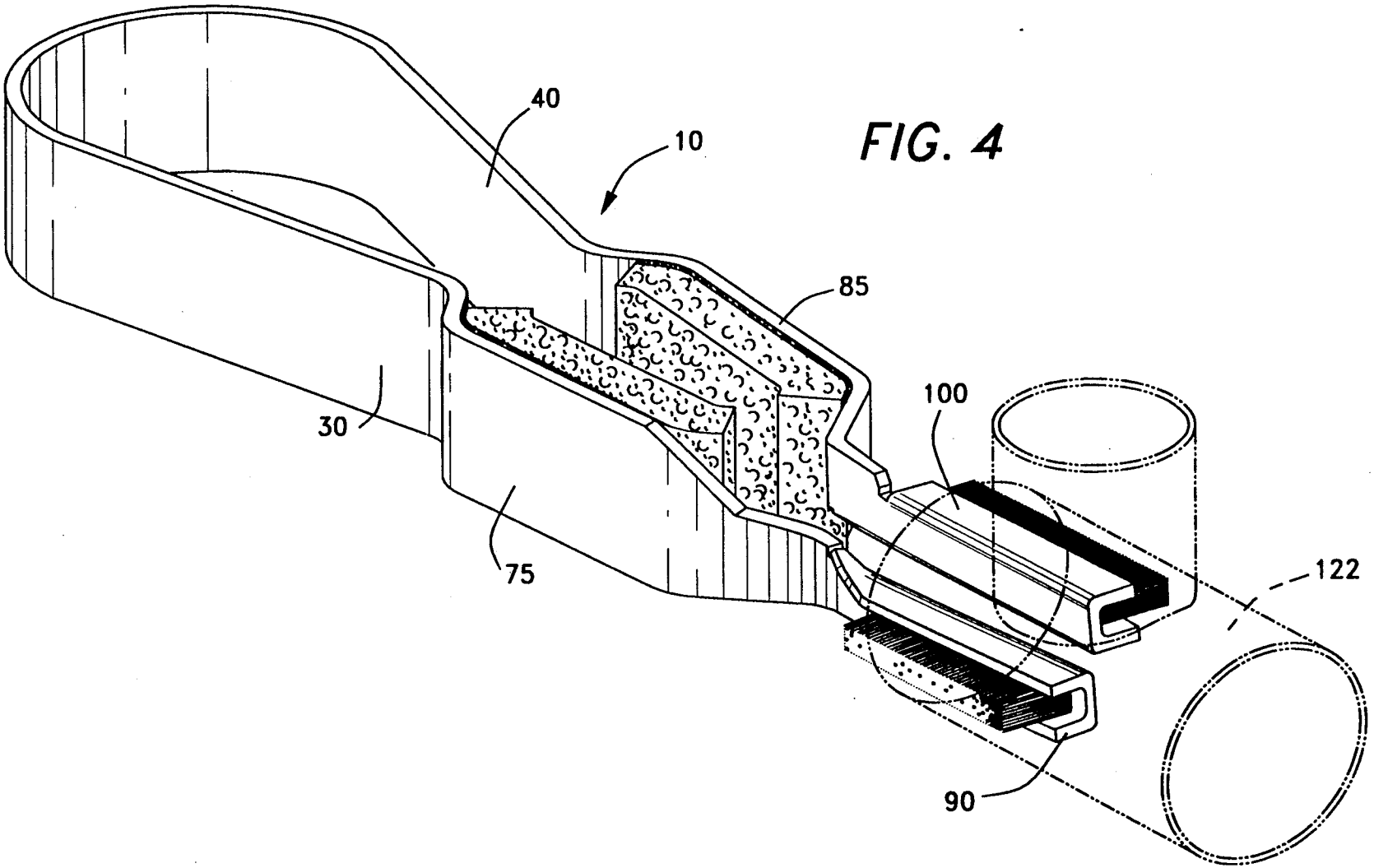
* and FIG. 4 is a perspective view of the cleaning tool of FIG. 1 being used to clean an inner surface of a pipe fitting.

As best seen in FIG. *2a*, the brush 90 extends in the distal direction from the distal transition member 76 at an acute angle F with respect to the longitudinal axis. Desirably, the angle F is chosen such that, with the brushes 90, 100 deflected to a position in which they lie generally adjacent to each other in the lateral direction (as illustrated in FIG. 4), the brushes 90, 100 are generally parallel to each other. This position is generally designed to be the smallest diameter pipe into which the distal end of the tool 10 can be inserted, as discussed in detail below. In an exemplary embodiment, angle $\Gamma$ is on the order of about 10°.

As FIGS. *2a* and *2b* illustrate, the brush 90 comprises a U-shaped channel 91 which houses a set of bristles 92. A base 93 and a pair of depending arms 94, 95 form the U-shaped channel 91. The bristles 92 have a uniform height and extend away from the longitudinal axis of the tool 10. The bristles 92 are crimped between the arms 94, 95 of the channel 91 to secure the bristles 92 in place.

The bristles are preferably steel fibers which extend beyond the channel 91 by about 0.25 inches. It is contemplated, however, that other cleaning elements, such as, for example, blades, abrasive members (e.g., stones or pads), squeegees, or the like, can be used as well in place of the brushes. Additionally, those skilled in the art will appreciate that the size of the cleaning elements (e.g., the length of the bristles 92) may be readily selected to suit a specific application.

Figures 2A, 2B, 2C, 2D:
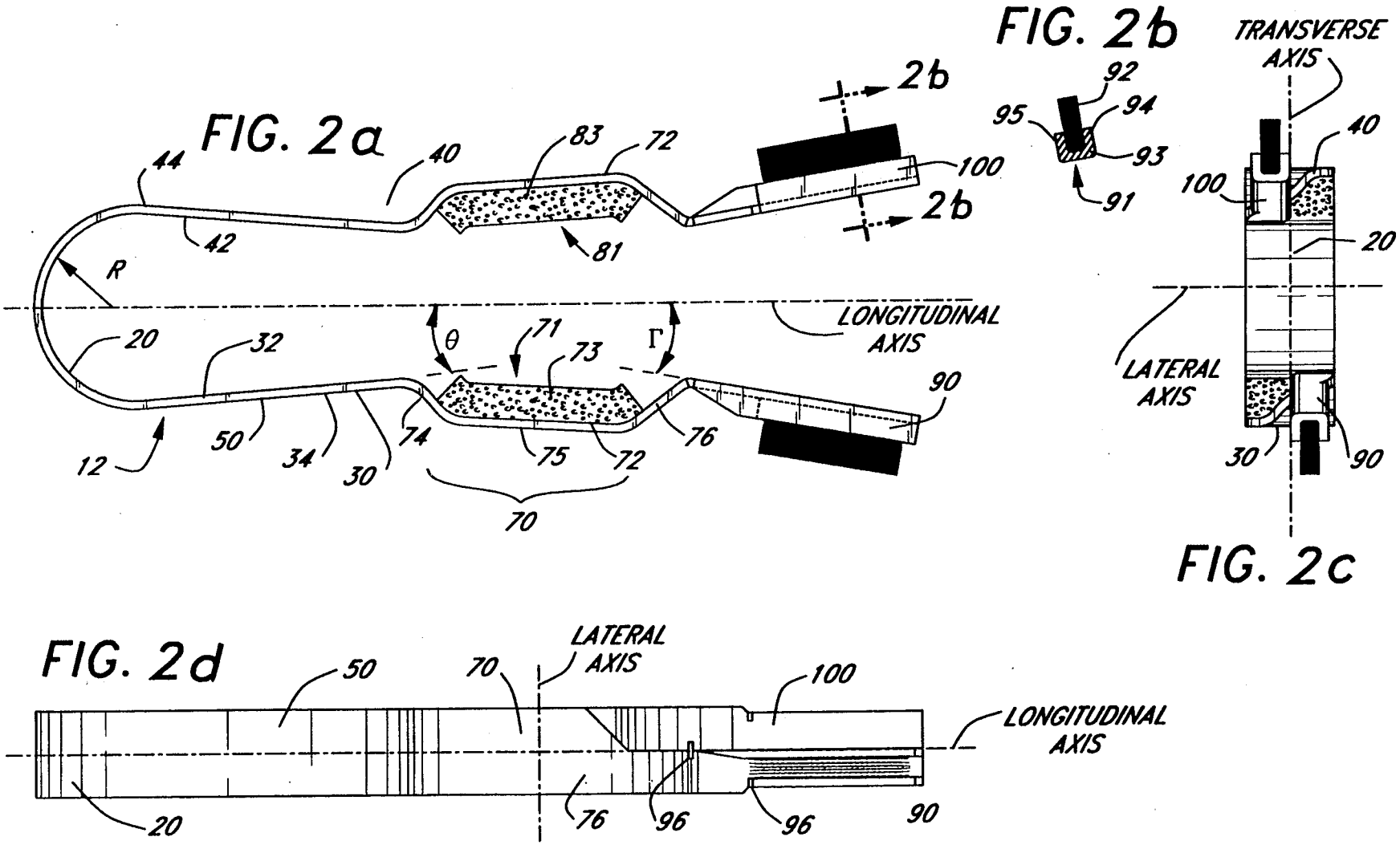
FIG. 2*a* is a side elevational view of the cleaning tool of FIG. 1.
FIG. 2*b* is a cross-sectional view of an external brush taken along line 2*b*–2*b* of FIG. 2*a;*
FIG. 2*c* is a front elevational view of the cleaning tool of FIG. 2*a;*
FIG. 2*d* is a bottom plan view of the cleaning tool of FIG. 2*a;*

As best shown in FIG. 2*c*, the opposing brushes 90, 100 are laterally offset from each other. That is, the first brush 90 is positioned to one side of the transverse axis and the second brush 100 is positioned to the opposite side of the transverse axis. The lateral offset of the brushes 90, 100 permits the brushes 90, 100 to pass next to each other when deflected in the transverse direction to facilitate the insertion of the brushes 90, 100 into pipes having diameters smaller than the combined back-to-back height of the brushes 90, 100, measured in the transverse direction, as illustrated in FIG. 4.

If the brushes 90, 100 were not laterally offset from each other, the base 93 of one brush would contact the opposing brush base at a point proximate to the longitudinal axis. The use of the brushes 90 would then be limited to pipes having a diameter larger than the combined height (measured along the transverse axis) of the brushes 90, 100. The present cleaning tool 10, in contrast, can be inserted into pipes having a diameter nearly as small as the height of a single brush 90, 100.

With reference to FIGS. 1 and 2*a*, each abrasive pad 73, 83 generally has a parallelepiped shape with upturned ends and is sized and shaped within to fit with the concave relief 71, 81 of the prong 30, 40, respectively. The abrasive pad 73, 83 preferably has a longitudinal length approximately equal to the diameter of the largest diameter pipe for which the tool 10 is designed to be used. The abrasive pad 73, 83 desirably comprises looping fibers which engage the hook fastener 72 disposed on the inner surface 32 of the hollow 70. In an exemplary embodiment, the abrasive pad comprises an abrasive material formed of an abrasive-impregnated, non-woven mat of synthetic fiber, such as the type commercially available as SCOTCHBRITE ® from Minnesota Mining & Manufacturing, Inc. (i.e., 3M). It is contemplated, however, that wire bristles, sanding or polishing media, blades, squeegees, or the like, can be used as well.

The flexible body 12 of the tool 10 may be constructed in any of a variety of ways which will be well known to one skilled in the art. For example, the flexible body 12 may be stamped or cast from a variety of durable material. The body 12 is preferably made from case-hardened or tempered carbon steel. The body 12 of the tool 1O may alternatively be integrally molded such as by injection molding.

Figures 3A, 3B:
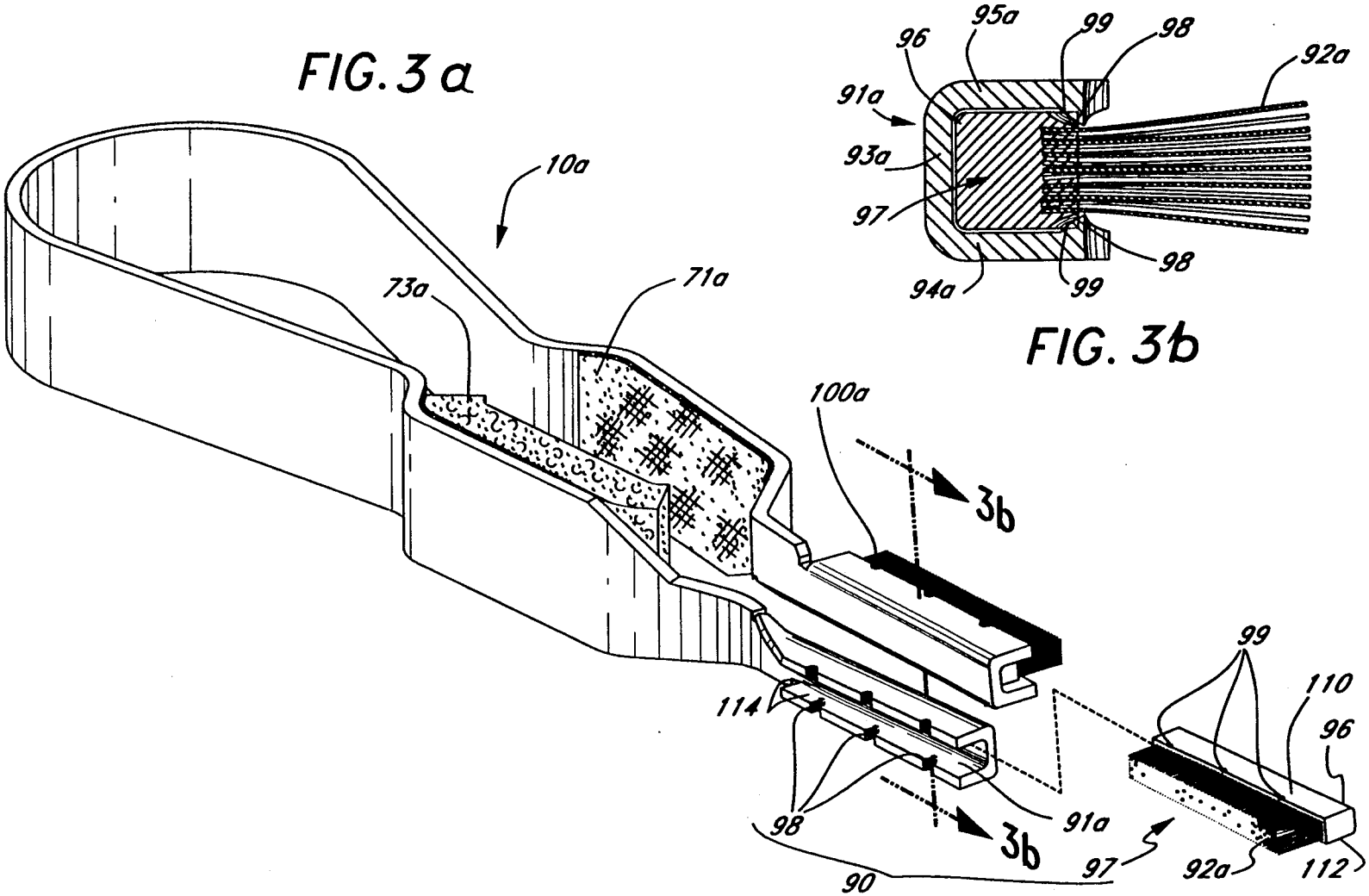

FIG. 3*a* illustrates a cleaning tool 10*a* in accordance with another preferred embodiment of the invention. Where appropriate, like numbers with an "a" suffix have been used to indicate like parts of the two embodiments for ease of understanding. The cleaning tool 10*a* is substantially identical to the cleaning tool 10 of the first embodiment except for the substitution of replaceable brushes 90*a*, 100*a*. This embodiment facilitates easy replacement of any worn bristles 92*a* and extends the life of the tool 10*a*. It is contemplated that the structure of the brushes 90*a*, 100*a* will be substantially identical, and a discussion herein of one will be understood as applying equally to both, unless specified to the contrary.

As illustrated by FIG. 3*a*, the brush 90*a* comprises a cartridge 97 which removably engages a U-shaped channel 91*a*. The cartridge 97 comprises a plurality of bristles 92*a* embedded in a base 96. The base 96 slides into the channel 91*a* and is removably secured in place by interengaging structure. Additionally, the base 96 desirably has a width (measured in the lateral direction) slightly larger than the width of the channel 91*a* so as to create an interference fit with the channel 91*a*.

The interengaging structure desirably comprises a plurality of notches 99 disposed along opposite sides 110, 112 of the base 96 and a plurality of teeth 98 correspondingly positioned along the inner edges 114 of the channel 92*a*. As FIG. 3*b* illustrates, each tooth 98 snaps into the corresponding notch 99 of cartridge 97 with the cartridge 97 properly positioned within the channel 91*a*. Once the cartridge 97 is snapped into position, the teeth 98 of the channel 91*a* aid in retaining the cartridge 97 in place.

To replace the cartridge 97, a screwdriver may be used to slide the cartridge 97 out of position. The tip of the screwdriver is positioned against the proximal end of the base 96, and is forced in the longitudinal direction towards the distal end of the tool 10. The base 96 plastically deforms as each tooth 98 is forced from the corresponding notch 99. The force applied is also sufficient to overcome the frictional force produced by the interference fit between the cartridge base 96 and the channel 91*a*.

In use, the tool 10*a* fits into the palm of a plumber's hand, with the base 20 of the tool resting on the palm and the thumb and forefinger grasping the platforms 75, 85 of the central hollows 70, 80.

As illustrated in FIG. 1, the tool 10 may be used to clean the external surface of a pipe 120 by inserting the pipe 120 between the abrasive pads 73, 83. Deflection of the prongs 30,40 towards each other in the transverse direction squeezes the abrasive pads 73, 83 against the pipe 120. The outer surface of the pipe 120 may be cleaned by rotating the tool 10 around a longitudinal axis of the pipe 120 or by moving the tool 10 parallel to the longitudinal axis of the pipe 120 in a back and forth motion. A combination of the above-described motions may also be used. Alternatively, the pipe 120 may be moved relative to the tool 10 to clean the outer surface of the pipe 120

With reference to FIG. 4, the tool 10 may also be used to clean the inner surface of a pipe fitting 122. The plumber urges the prongs 30, 40 of the tool 10 together by squeezing the tool 10 between the plumber's thumb and forefinger positioned on opposing platforms 75, 85. The extent of deflection required depends upon the pipe inner diameter; more deflection is required for smaller pipes.

Once inserted, the deflected prongs 30, 40 of the tool 10 spring back in an outward direction (i.e., away from the longitudinal axis) to bias the brushes 90, 100 against the inside of the pipe fitting 122. The elastic deflection of the prongs 30, 40 produces a sufficient spring force to firmly force the bristles 92 against the inner wall of the pipe fitting 122.

The plumber cleans the pipe fitting 122 by rotating the tool 10 around a longitudinal axis of the fitting 122 or by moving the tool 10 back and forth in a direction parallel to the longitudinal axis of the fitting 122. A combination of the above-described motions may also be used. Alternatively, the pipe fitting 122 may be moved relative to the tool 10 to clean the inner surface of the fitting 122.

The flexibility of the body 12 enables the tool 10 to accommodate pipes and other plumbing components of various dimensions. In a preferred embodiment, the tool 10 can accommodate pipes and fittings with inner diameters ranging from ½ inch to 1⅛ inches. However, those skilled in the art will appreciate that the dimensions of the tool can be readily customized to suit a desired range of pipe sizes.

Although this invention has been described in terms of certain preferred embodiments, other embodiments apparent to those of ordinary skill in the art are also within the scope of this invention. Accordingly, the scope of the invention is intended to be defined only by the claims which follow.

We claim:

1. A cleaning tool for preparing plumbing pipes and fittings to be soldered, welded, glued or likewise interconnected, said cleaning tool comprising:

a first prong having an inner side and an outer side, said first prong comprising:

a first proximal arm;

a first central hollow defining a first concave relief disposed on said inner side of said first prong, said first central hollow being attached to a distal end of said first proximal arm; and a first brush extending from a distal end of said first central hollow, said first brush comprising a generally U-shaped channel and a plurality of bristles positioned within said channel and extending outwardly from said outer side of said first prong;

a second prong having an inner side and an outer side and being oriented with said inner side of said second prong opposing said inner side of said first prong, said second prong comprising:

a second proximal arm;

a second central hollow defining a second concave relief disposed on said inner side of said second prong, said second central hollow being attached to a distal end of said second proximal arm, said second concave relief of said second prong generally opposing said first concave relief; and a second brush extending from a distal brush comprising a generally U-shaped channel and a plurality of bristles positioned within said channel and extending outwardly from said outer side of said second prong, said second brush of said second prong facing away from said first brush; and an arcuate base interconnecting said first prong and said second prong such that a distance between said first central hollow and said second central hollow is greater than an outer diameter of the pipe or fitting to be cleaned.

2. The cleaning tool of claim 1, additionally comprising a first abrasive member and a second abrasive member being sized to fit within said first and second concave reliefs of said first and second hollows, respectively, and being removably attached thereto.

3. The cleaning tool of claim 2, wherein each of said abrasive members is constructed of an abrasive-impregnated, non-woven mat of synthetic fiber.

4. The cleaning tool of claim 3, wherein each of said abrasive members is retained by a hook fastener.

5. The cleaning tool of claim 1, wherein said first and second brushes are generally parallel to each other with said first and second prongs being urged together.

6. The cleaning tool of claim 1, wherein said tool is constructed of a durable material selected from the group comprising metal, metallic alloys and plastic.

7. The cleaning tool of claim 6, wherein said tool is constructed of tempered carbon steel.

8. The cleaning tool of claim 1, wherein said bristles of said first and second brushes are replaceable.

9. The cleaning tool of claim 1, wherein said first brush extends from the distal end of said first central hollow at an acute angle to a longitudinal axis of said tool, and said second brush extends from the distal end of said second central hollow at an acute angle to the longitudinal axis of said tool.

10. The cleaning tool of claim 9, wherein said acute angles are each generally on the order of 10 degrees.

11. The cleaning tool of claim 1, wherein said first and second brushes are laterally offset from each other with said first and second prongs urged together.

12. A cleaning tool for cleaning pipes and fittings of various diameters, said tool comprising:

a flexible, generally U-shaped body with a pair of opposing prongs extending from a base;

a pair of abrasive members for cleaning an exterior surface of a pipe or a fitting, said abrasive members being disposed on opposing inner surfaces of said opposing prongs and being positioned distal of said base; and a pair of brushes having bristles for cleaning an interior surface of a pipe or a fitting, said brushes being positioned generally opposite from each other with the bristles of each brush extending away from a longitudinal axis of said tool, said brushes being disposed on opposite outer surfaces of said opposing prongs and being positioned distal of said base.

13. The cleaning tool of claim 12, wherein said brushes are parallel to each other with said prongs being urged together.

14. The cleaning tool of claim wherein said brushes are replaceable.

15. The cleaning tool of claim 12, wherein said abrasive members are replaceable.

16. The cleaning tool of claim 12, wherein said brushes are laterally offset such that, with said prongs being urged together, said brushes lie adjacent to each other.

17. A tool for cleaning pipes and fittings comprising:

a flexible body being configured to deflect from a first position to a second position, said body defining a longitudinal axis;

a pair of opposing abrasive elements disposed within said flexible body and positioned to contact an exterior surface of the pipe or fitting with said flexible body deflected in said first position; and a pair of exterior cleaning elements disposed on an exterior of said flexible body and positioned to contact an interior surface of the pipe or fitting, said exterior cleaning elements being laterally offset from each other such that with said flexible body deflected in said second position, said exterior cleaning elements generally lie adjacent to each other.

18. The tool of claim 17, wherein said flexible body generally has a U-shape defined by a pair of opposing prongs extending from an arcuate end.

19. The tool of claim 18, wherein said abrasive elements are disposed on interior surfaces of said prongs distal of said arcuate end.

20. The tool of claim 17, wherein said tool is configured to have variable deflection so as to accommodate pipes and fittings of various sizes.

* * * * *

UNITED STATES PATENT AND TRADEMARK OFFICE

CERTIFICATE OF CORRECTION

PATENT NO. : 5,295,278

DATED : March 22, 1994

INVENTOR(S) : Duane R. Condon, et al

It is certified that error appears in the above-indentified patent and that said Letters Patent is hereby corrected as shown below:

Column 8, line 37, insert --12-- after "The cleaning tool of claim"

Signed and Sealed this

Nineteenth Day of September, 1995

*Attest:*

Bruce Lehman

BRUCE LEHMAN

*Attesting Officer*

*Commissioner of Patents and Trademarks*